US012326322B1

(12) United States Patent
Anderson

(10) Patent No.: US 12,326,322 B1
(45) Date of Patent: Jun. 10, 2025

(54) LOAD TRANSFER SYSTEM FOR TACTICAL PLATE CARRIERS

(71) Applicant: Joshua D Anderson, Belmont, NC (US)

(72) Inventor: Joshua D Anderson, Belmont, NC (US)

( * ) Notice: Subject to any disclaimer, the term of this patent is extended or adjusted under 35 U.S.C. 154(b) by 0 days.

(21) Appl. No.: 18/539,438

(22) Filed: Dec. 14, 2023

Related U.S. Application Data

(60) Provisional application No. 63/435,054, filed on Dec. 23, 2022.

(51) Int. Cl.
*F41H 5/013* (2006.01)

(52) U.S. Cl.
CPC ..... *F41H 5/013* (2013.01)

(58) Field of Classification Search
CPC ..... F41H 1/02; F41H 5/08; F41H 5/13
See application file for complete search history.

(56) References Cited

U.S. PATENT DOCUMENTS 1,722,205 A * 7/1929 Freund ..... A61F 5/024 602/19
3,029,810 A * 4/1962 Martin ..... A61F 5/024 248/407
4,715,362 A * 12/1987 Scott ..... A61F 5/024 602/19
4,721,102 A * 1/1988 Pethybridge ..... A61F 5/024 602/19
7,549,968 B2 * 6/2009 Cojbasic ..... A61F 5/026 602/5
8,990,971 B2 * 3/2015 Carter ..... A45F 3/10 2/2.5
8,991,671 B2 * 3/2015 Gill ..... A45F 3/08 224/628
9,161,609 B2 * 10/2015 Milligan ..... A45F 3/06
9,185,964 B2 * 11/2015 Crye ..... A45F 3/047
9,629,443 B2 * 4/2017 Searle ..... A45F 3/10
9,777,997 B2 * 10/2017 Swan ..... A41D 13/0518
9,820,514 B2 * 11/2017 Nykoluk ..... A41D 13/0007
9,987,159 B2 * 6/2018 Williams ..... A61F 5/024
11,058,210 B2 * 7/2021 Lennings ..... F16M 13/04
11,178,958 B2 * 11/2021 Nordmann ..... A45F 3/08
D950,076 S * 4/2022 Katoh ..... D29/100
D958,374 S * 7/2022 Katoh ..... D29/100
D961,164 S * 8/2022 Cader ..... D29/101.3
12,082,631 B2 * 9/2024 Johnson ..... A41D 1/04
(Continued)

*Primary Examiner* — Joshua E Freeman
(74) *Attorney, Agent, or Firm* — Kyle A. Fletcher, Esq.

(57) ABSTRACT

The load transfer system for tactical plate carriers includes a top interface, a bottom interface, and a linkage. The top interface may couple to an armor plate directly or indirectly via a plate carrier. The bottom interface may couple to anatomically inferior gear located below the top interface. The top end of the linkage may couple to the top interface and the bottom end of the linkage may couple to the bottom interface. The load transfer system may be adapted to be worn by a user to transfer a load from the user's shoulders and/or lower back to the users' hips. As a non-limiting example, the load May comprise the weight of the armor plate and/or the weight of gear suspended from the plate carrier. The load transfer system may permit movement of the armor plate relative to the anatomically inferior gear.

17 Claims, 7 Drawing Sheets

(56) References Cited

U.S. PATENT DOCUMENTS

| | | | | |
|---|---|---|---|---|
| 2010/0076359 | A1* | 3/2010 | Glenn | A45F 3/14 602/19 |
| 2013/0047320 | A1* | 2/2013 | Gleason | A45F 3/06 2/312 |
| 2014/0151424 | A1* | 6/2014 | Hexels | A45F 3/06 224/637 |
| 2016/0033235 | A1* | 2/2016 | Kinnings | A45F 3/12 2/102 |
| 2017/0095063 | A1* | 4/2017 | Rowell | A45F 3/14 |
| 2018/0318693 | A1* | 11/2018 | Corrigan | A41D 13/0506 |
| 2018/0321017 | A1* | 11/2018 | Jonassen | F41H 1/02 |
| 2021/0077336 | A1* | 3/2021 | Van Engelhoven | A61F 5/028 |

* cited by examiner

LOAD TRANSFER SYSTEM FOR TACTICAL PLATE CARRIERS

CROSS REFERENCES TO RELATED APPLICATIONS

This application claims the benefit of priority to U.S. Provisional Application No. 63/434,054, filed Dec. 20, 2022, which is incorporated by reference herein in its entirety.

STATEMENT REGARDING FEDERALLY SPONSORED RESEARCH

Not Applicable

REFERENCE TO APPENDIX

Not Applicable

BACKGROUND OF THE INVENTION

A plate carrier may be gear that may be donned to carry one or more armor plates as part of a personal ballistic protection system. Plate carriers have been static in design with regard to the suspension of the plate carrier from the shoulders. Plate carriers weigh 14-25 lbs with armor plates but are often loaded with upwards of 50 lbs of additional gear. This produces great strain on the shoulders and/or lower back of the wearer and may result in injury or even permanent disability. Full body exoskeletons would solve these issues, but such devices have not yet been successfully developed. Current plate carrier and battle belt systems are highly refined and modularized and not likely to be phased out for many years. In addition, the current systems are expensive and often highly individualized.

FIELD OF THE INVENTION

The present invention relates to the fields of tactical armor and personal ballistic protection systems, more specifically, a load transfer system for tactical plate carriers.

SUMMARY OF INVENTION

The load transfer system for tactical plate carriers comprises a top interface, a bottom interface, and a linkage. The top interface may couple to an armor plate directly or indirectly via a plate carrier. The bottom interface may couple to anatomically inferior gear located below the top interface. As a non-limiting example, the anatomically inferior gear may be hip-level gear such as a pants belt, a battle belt, or a backpack hip belt. The top end of the linkage may couple to the top interface and the bottom end of the linkage may couple to the bottom interface.

The load transfer system may be adapted to be worn by a user to transfer a load from the user's shoulders and lower back to the users' hips. As a non-limiting example, the load may comprise the weight of the armor plate and/or the weight of gear suspended from the plate carrier. The load transfer system may permit movement of the armor plate relative to the anatomically inferior gear. The load transfer system may be light weight such that the load transfer system does not add significantly to the load.

An object of the invention is to transfer a load resulting from wearing an armor plate, a plate carrier, additional gear suspended from the plate carrier, or any combination thereof from a user's shoulders and/or lower back to anatomically inferior gear.

Another object of the invention is to provide a top interface that may detachably couple to the armor plate or to the plate carrier.

A further object of the invention is to provide a bottom interface that may detachably couple to anatomically inferior gear, non-limiting examples of which comprise pants belts, battle belts, and backpack hip belts.

Yet another object of the invention is to provide a linkage that may couple to the top interface and to the bottom interface, may convey the load from the top interface to the bottom interface, and may deform to permit movement of the top interface relative to the bottom interface.

These together with additional objects, features and advantages of the load transfer system for tactical plate carriers will be readily apparent to those of ordinary skill in the art upon reading the following detailed description of the presently preferred, but nonetheless illustrative, embodiments when taken in conjunction with the accompanying drawings.

In this respect, before explaining the current embodiments of the load transfer system for tactical plate carriers in detail, it is to be understood that the load transfer system for tactical plate carriers is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the load transfer system for tactical plate carriers.

It is therefore important that the claims be regarded as including such equivalent construction insofar as they do not depart from the spirit and scope of the load transfer system for tactical plate carriers. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
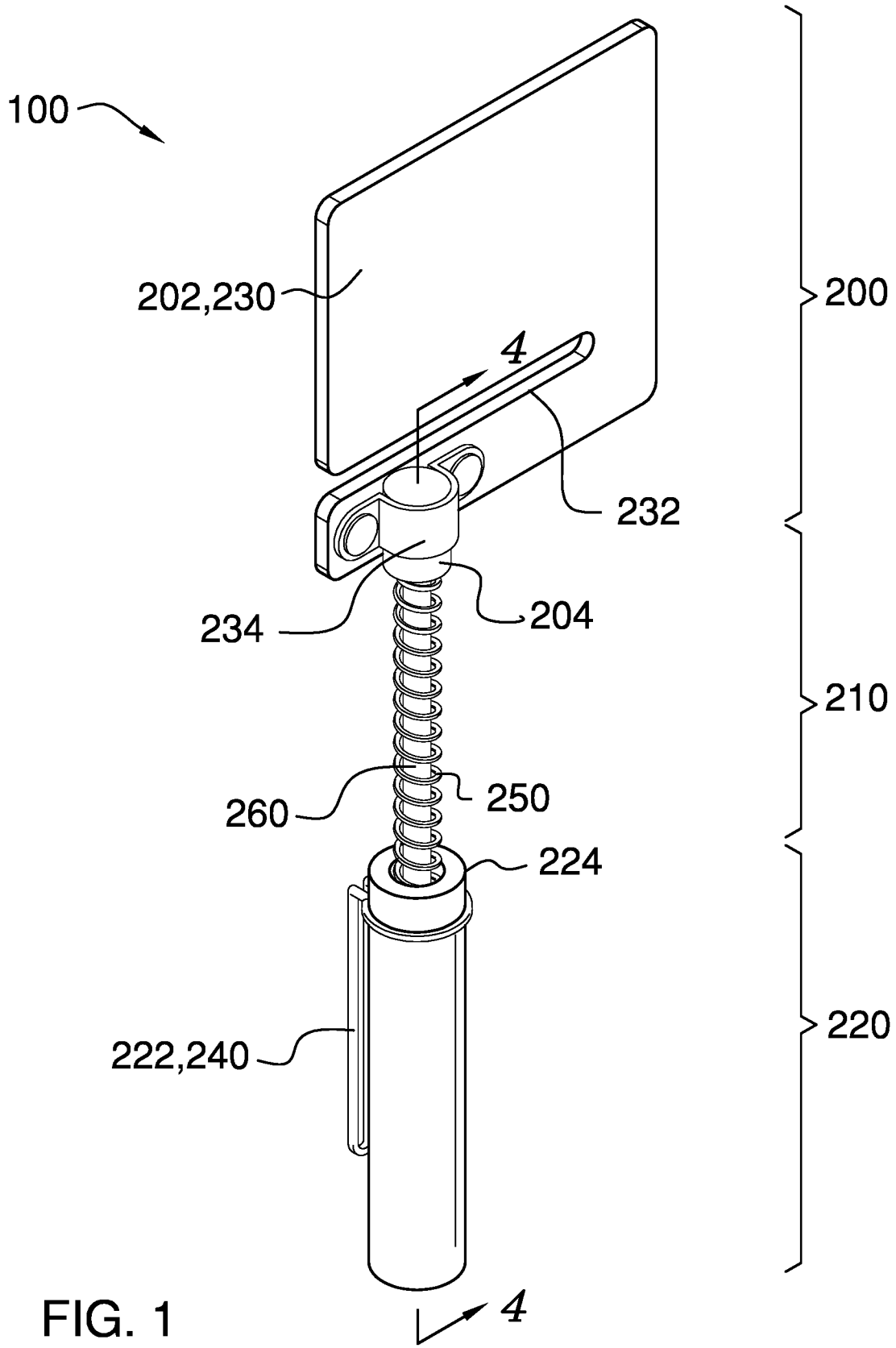
FIG. 1 is an isometric view of an embodiment of the disclosure.
Figure 2:
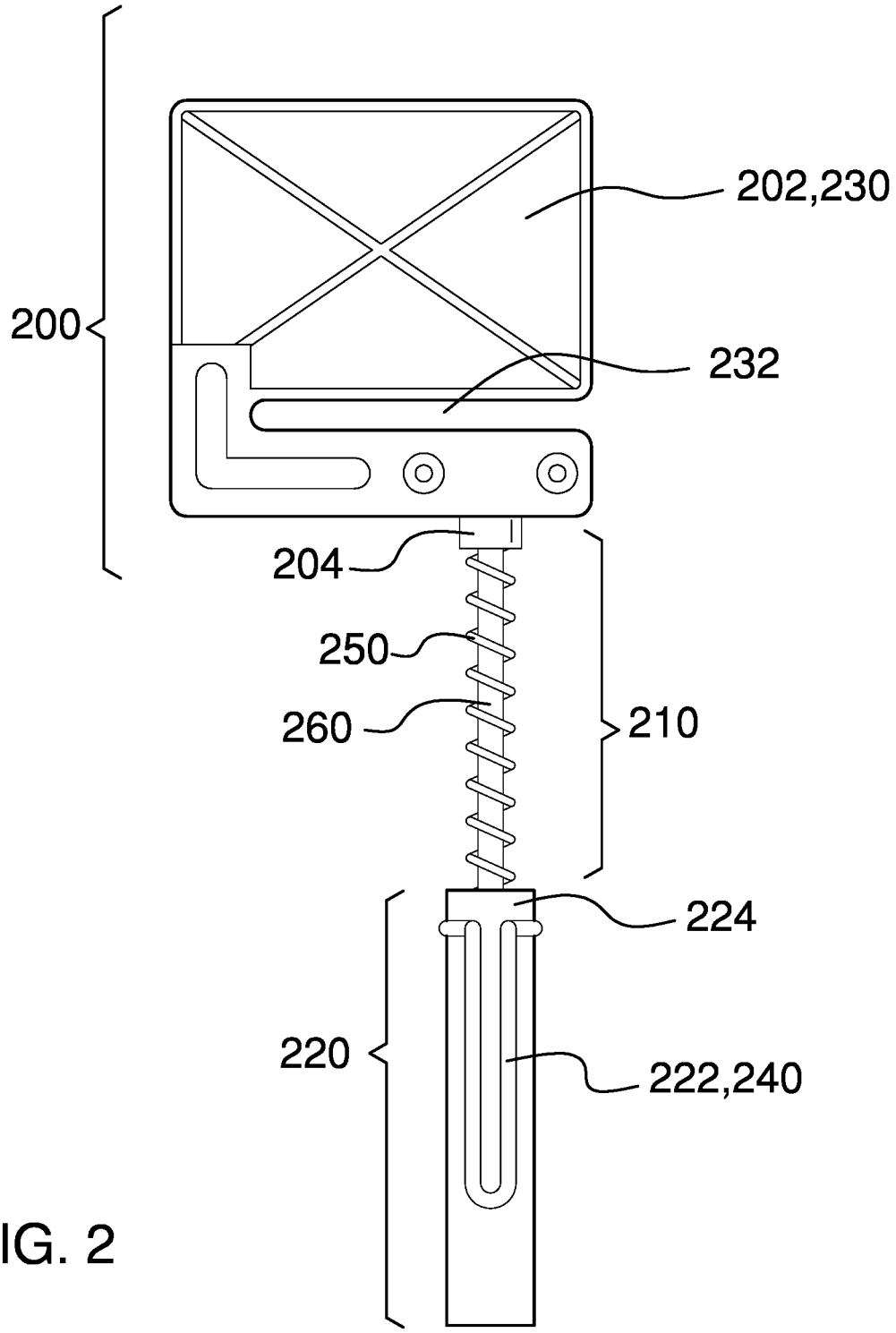
FIG. 2 is a rear view of an embodiment of the disclosure.
Figure 3:
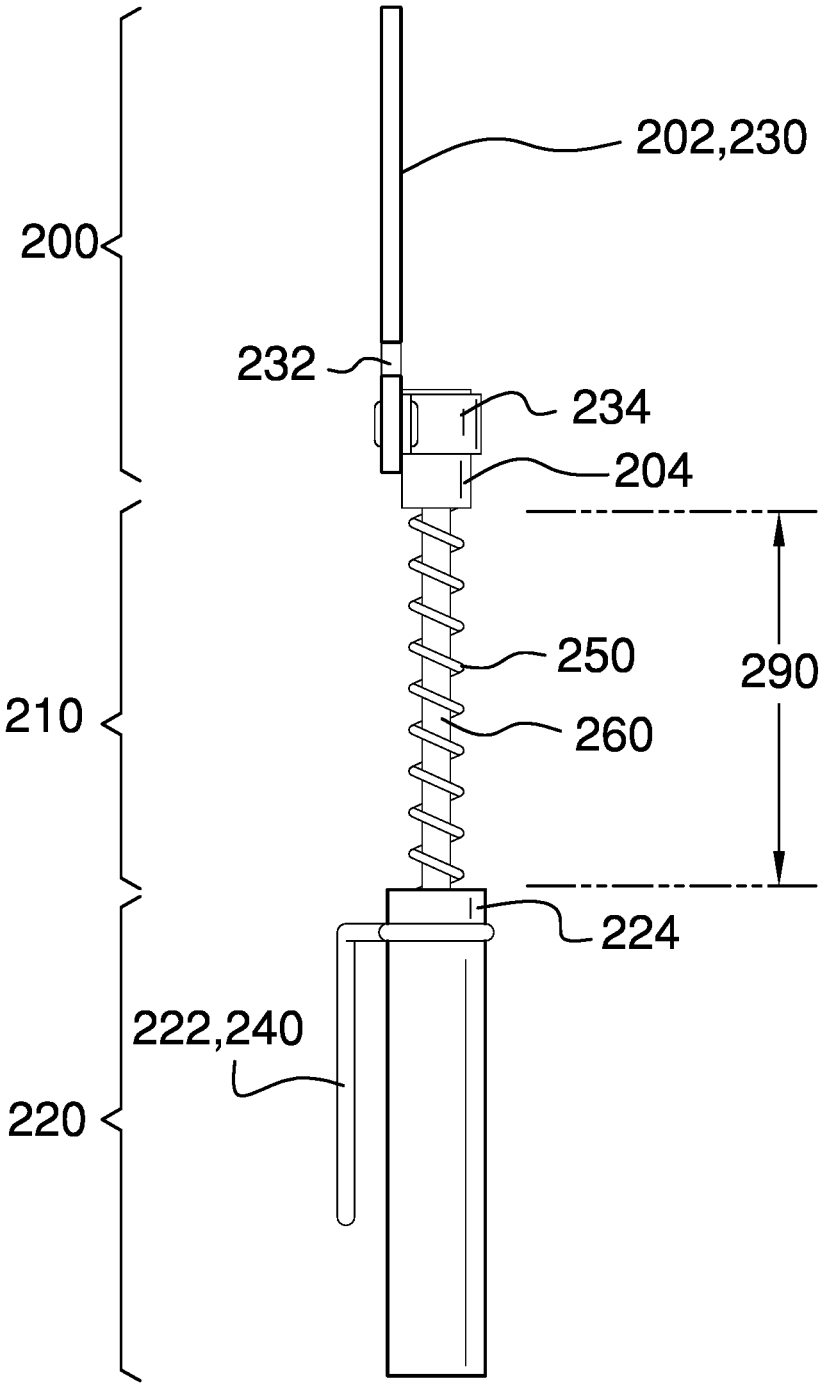
FIG. 3 is a side view of an embodiment of the disclosure.
Figure 4:
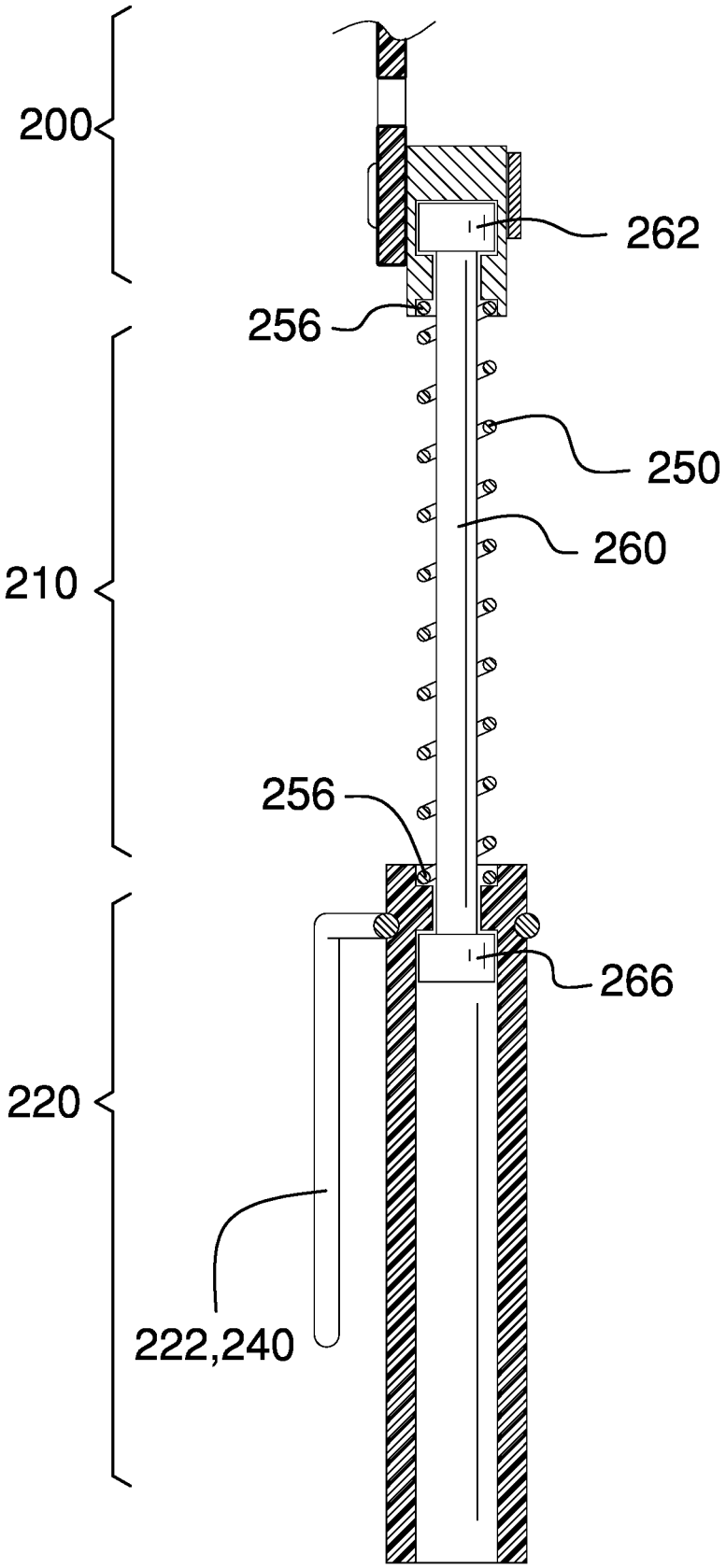
FIG. 4 is a cross-sectional view of an embodiment of the disclosure across 4-4 as shown in FIG. 1.
Figure 5:
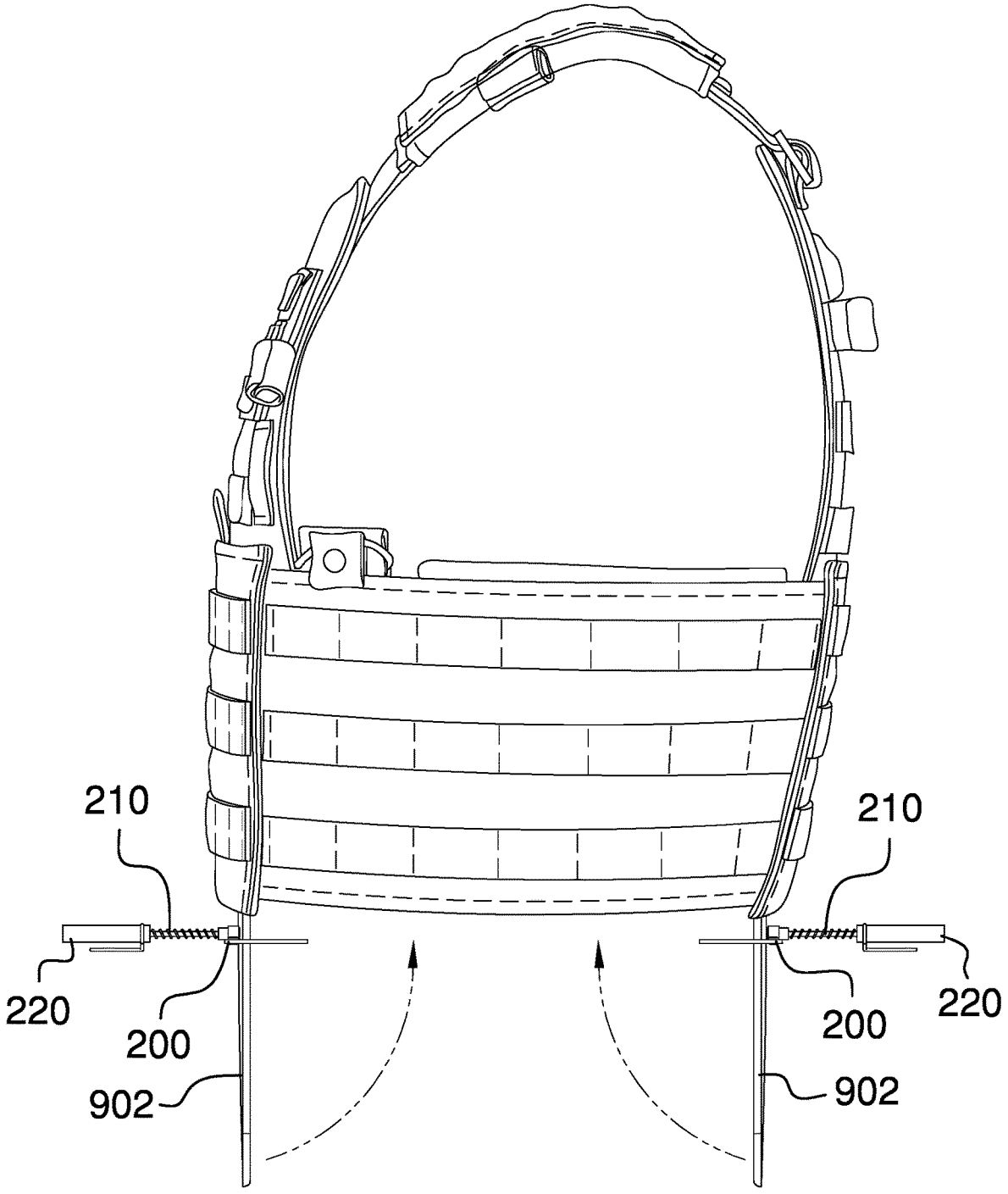
FIG. 5 is an in-use view of an embodiment of the disclosure, illustrating the top interface being coupled to the bottom of the plate carrier.
Figure 6:
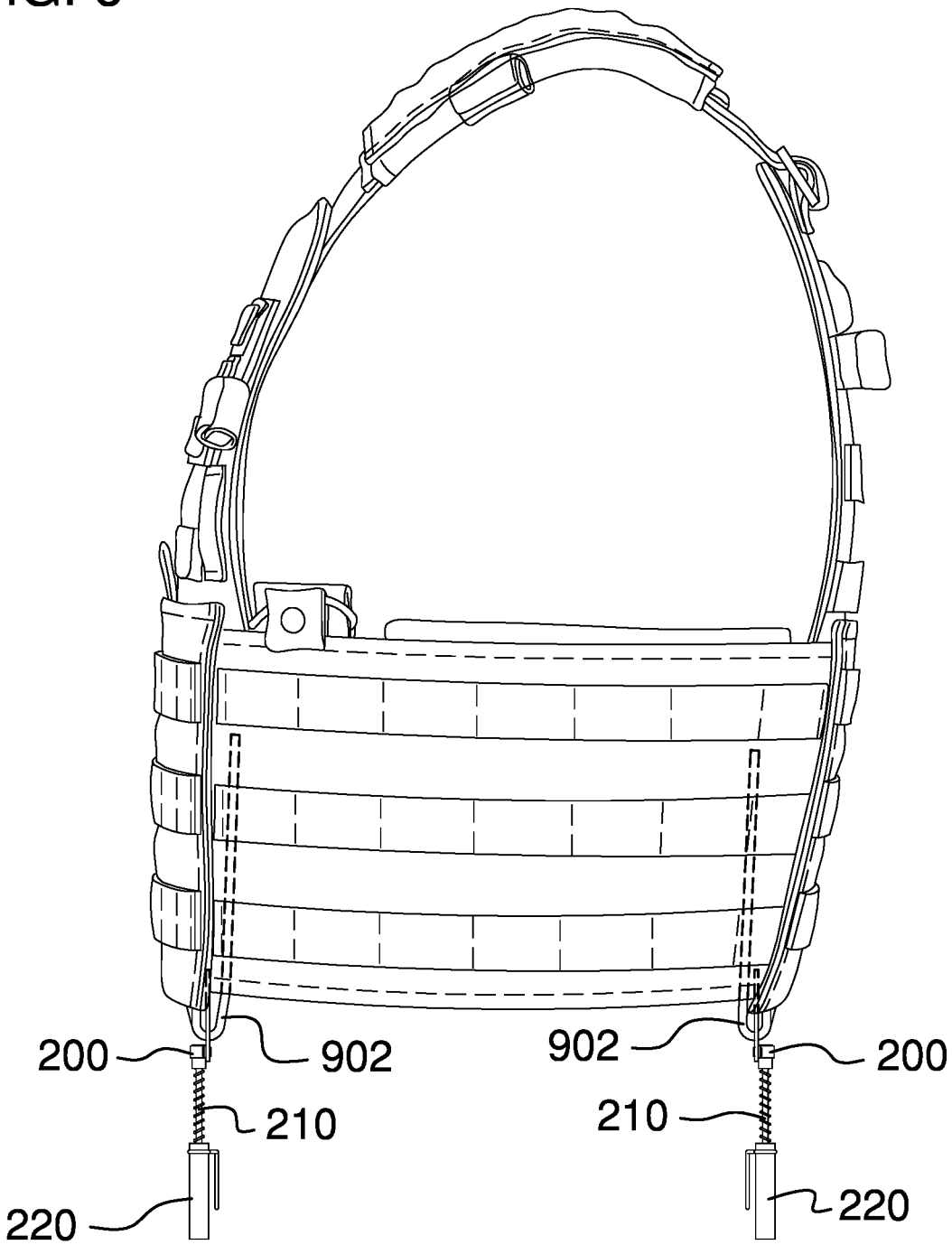
FIG. 6 is an in-use view of an embodiment of the disclosure, illustrating the top interface coupled to the plate carrier.
Figure 7:
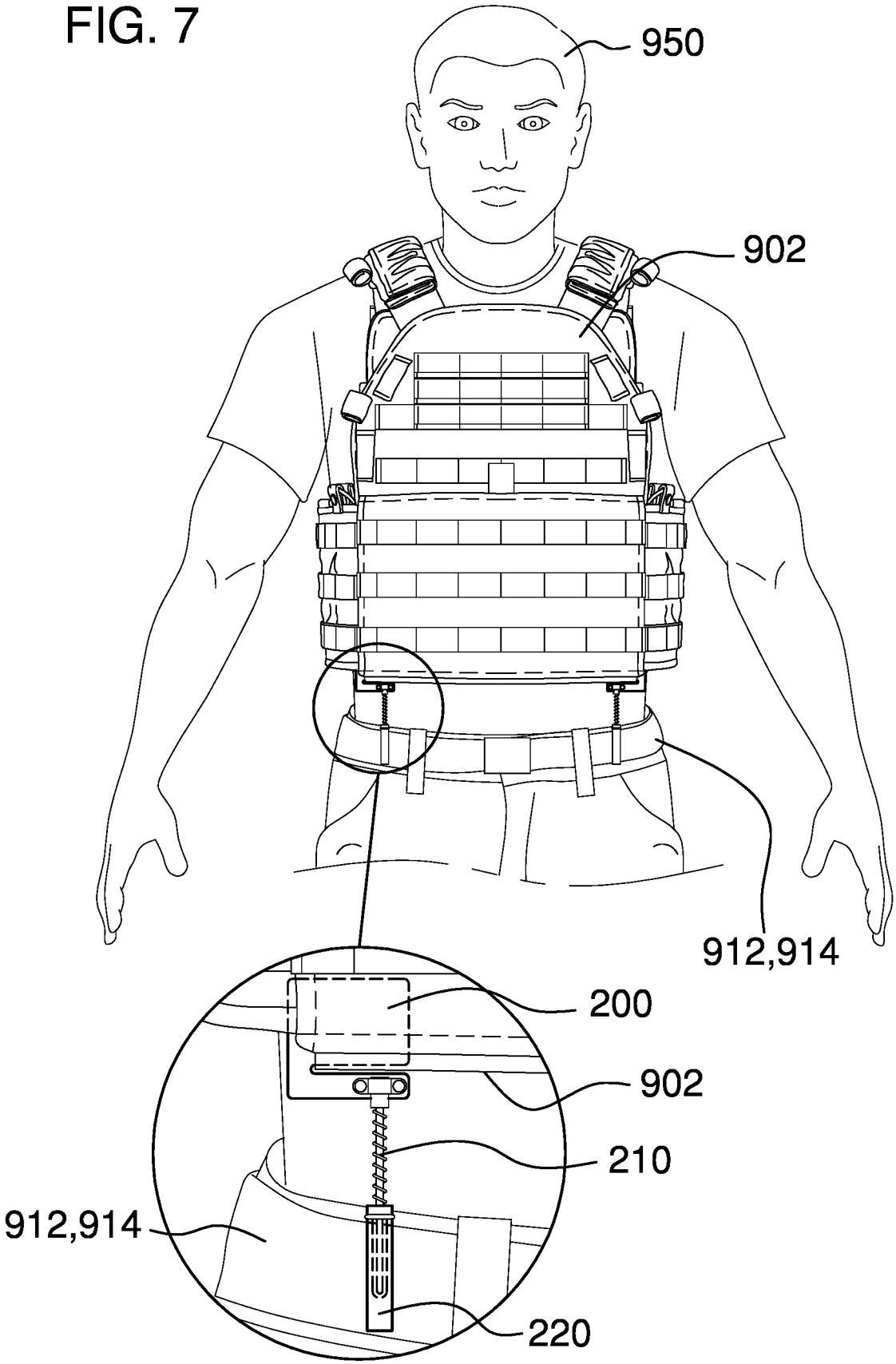
FIG. 7 is an in-use view of an embodiment of the disclosure, illustrating the invention in place and transferring the load from the plate carrier to the anatomically inferior gear.

Detailed reference will now be made to a first potential embodiment of the disclosure, which is illustrated in FIGS. 1 through 7.

The load transfer system for tactical plate carriers 100 (hereinafter invention) comprises a top interface 200, a bottom interface 220, and a linkage 210. The top interface 200 may couple to an armor plate directly or indirectly via a plate carrier 902. The bottom interface 220 may couple to anatomically inferior gear 912 located below the top interface 200. As a non-limiting example, the anatomically inferior gear 912 may be hip-level gear 914 such as a pants belt, a battle belt, or a backpack hip belt. The top end of the linkage 210 may couple to the top interface 200 and the bottom end of the linkage 210 may couple to the bottom interface 220. The invention 100 may be adapted to be worn by a user 950 to transfer a load from the user's shoulders and/or lower back to the users' hips. As a non-limiting example, the load may comprise the weight of the armor plate and/or the weight of gear suspended from the plate carrier 902. The invention 100 may permit movement of the armor plate relative to the anatomically inferior gear 912. The invention 100 may be light weight such that the invention 100 does not add significantly to the load.

The top interface 200 may comprise a plate coupler 202 and a top linkage coupler 204. The plate coupler 202 may couple to the armor plate and/or to the plate carrier 902. The top linkage coupler 204 may couple to the top of the linkage 210. The top interface 200 may be operable to convey the load from the plate coupler 202 to the top linkage coupler 204 and may thereby convey the load from the armor plate or the plate carrier 902 to the linkage 210.

The bottom interface 220 may comprise a bottom linkage coupler 224 and a bottom gear coupler 222. The bottom linkage coupler 224 may couple to the bottom of the linkage 210. The bottom gear coupler 222 may couple to the anatomically inferior gear 912. The bottom interface 220 may be operable to convey the load from the bottom linkage coupler 224 to the bottom gear coupler 222 and may thereby convey the load from the linkage 210 to the anatomically inferior gear 912.

The top of the linkage 210 may couple to the top linkage coupler 204 of the top interface 200. The bottom of the linkage 210 may couple to the bottom linkage coupler 224 of the bottom interface 220. The linkage 210 may be operable to convey the load from the top of the linkage 210 to the bottom of the linkage 210 and may thereby convey the load from the top interface 200 to the bottom interface 220. The linkage 210 may deform and/or move relative to the top interface 200, the bottom interface 220, or both such that a separation distance 290 between the top interface 200 and the bottom interface 220 and/or orientation of the top interface 200 relative to the bottom interface 220 may change. Specifically, the linkage 210 may permit the top interface 200 to move up, down, left, right, forward, backward, or any combination thereof relative to the bottom interface 220, may permit rotation of the top interface 200 about a vertical axis relative to the bottom interface 220, may permit rotation of the top interface 200 about any horizontal axis relative the bottom interface 220, or any combination thereof. The linkage 210 may therefore permit the position of the armor plate and/or the plate carrier 902 to change relative to the anatomically inferior gear 912 as the user 950 moves.

As non-limiting examples, the linkage 210 may comprise one or more articulated joints, one or more rods, one or more cables, one or more hydraulic dampers, one or more pneumatic dampers, one or more armatures, one or more springs, or any combination thereof.

As non-limiting examples, an individual coupler selected from the plate coupler 202, the top linkage coupler 204, the bottom gear coupler 222, and the bottom linkage coupler 224 may comprise one or more snaps, one or more buckles, one or more hook and loop fasteners, one or more clips, one or more clamps, one or more magnets, one or more ball joints, one or more swages, one or more cable connectors, one or more welded joints, an adhesive, a molle system attachment, a tactical gear attachment, or any combination thereof.

In a preferred embodiment, the top interface 200 may comprise a plate clip 230. The plate clip 230 may comprise a slot that may be operable to couple to the plate carrier 902. As a non-limiting example, the slot 232 may slide onto an edge of the plate carrier 902. In some embodiments, the plate clip 230 may be coupled to the top interface 200 via a bracket 234.

In a preferred embodiment, the bottom interface 220 may comprise a belt clip 240. The belt clip 240 may comprise a downward-oriented hook that may slide down onto the anatomically inferior gear 912 from the top. It shall be noted that the belt clip 240 may be alternatively referred to as a clip. The clip 240 would be able to be used in concert with other objects aside of a belt, which may include a Molle system.

In a preferred embodiment, the linkage 210 may comprise a compression spring 250 and a swage cable 260. The top of the compression spring 250 may be coupled to the top interface 200 at the top linkage coupler 204 and the bottom of the compression spring 250 may be coupled to the bottom interface 220 at the bottom linkage coupler 224. The compression spring 250 may convey the load from the top interface 200 to the bottom interface 220. The compression spring 250 may permit the separation distance 290 between the top interface 200 and the bottom interface 220 to decrease by compression of the compression spring 250. As non-limiting examples, the coupling between the top interface 200 and the linkage 210 and between the linkage 210 and the bottom interface 220 may be recessed seats 256.

The compression spring 250 may be replaced with a linkage member, which does not compress or is semi-rigid in nature.

The swage cable 260 may be a cable comprising a top cable terminal 262 and a bottom cable terminal 266. The swage cable 260 may limit the separation distance 290 to a maximum separation distance. In some embodiments, the bottom cable terminal 266 may be slidably coupled to the bottom linkage coupler 224 of the bottom interface 220 such that as the separation distance 290 between the top interface 200 and the bottom interface 220 decreases, the bottom cable terminal 266 may slide through the bottom interface 220 to accommodate the change in geometry of the invention 100. The top cable terminal 262 may be held captive by the top linkage coupler 204 of the top interface 200.

As non-limiting examples, the top interface 200, the bottom interface 220, the linkage 210, or any combination thereof may be made of metal, plastic, fiber reinforced composite materials, natural or synthetic rubber, textile, or any combination thereof.

In use, a user 950 may don tactical gear in the course of preparing for combat, law enforcement, training, and security scenarios. As a non-limiting example, the tactical gear may comprise an armor plate worn in a plate carrier 902 on the user's toro, anatomically inferior gear 912 such as a battle belt located below the armor plate, and additional gear suspended from the plate carrier 902. The armor plate and the gear may comprise a load that may strain the user's shoulders and/or lower back. To transfer at least part of the load off of the upper body, the user 950 may couple one or more instances of the invention 100 between the plate carrier 902 and the anatomically inferior gear 912. As non-limiting examples, the user 950 may couple the invention 100 between the plate carrier 902 and the anatomically inferior gear 912 on the front right, front left, rear right, and rear left of the plate carrier 902 to convey the load from the plate carrier 902 and the gear to the anatomically inferior gear 912. As the user 950 walks, runs, bends, turns, and leans to either side, the inventions 100 may deform to match the differential movement of the plate carrier 902 and the anatomically inferior gear 912 while continuing to convey the load to the anatomically inferior gear 912.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "battle belt" may refer to a tactical belt worn around the waist and operable to carry essential items such as ammunition, holsters, and first aid kits. A battle belt may comprise Pouch Attachment Ladder System (PALS) webbing to attach Modular Lightweight Load-carrying Equipment (MOLLE) compatible pouches.

As used herein, "clip" may refer to a fastener that attaches to an object by gripping or clasping the object. A clip may be spring loaded.

As used in this disclosure, a "compression spring" may be a wire coil that resists forces attempting to compress the wire coil in the direction of the center axis of the wire coil. The compression spring will return to its original position when the compressive force is removed.

As used herein, the words "couple", "couples", "coupled" or "coupling", may refer to connecting, either directly or indirectly, and does not necessarily imply a mechanical connection.

As used in this disclosure, a "fastener" may be a device that is used to join or affix two objects. Fasteners May generally comprise a first element which is attached to the first object and a second element which is attached to the second object such that the first element and the second element join to affix the first object and the second object. Common fasteners may include, but are not limited to, hooks, zippers, snaps, clips, ties, buttons, buckles, quick release buckles, or hook and loop fasteners.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used in this disclosure, a "hook and loop fastener" may be a fastener that comprises a hook surface and a loop surface. The hook surface may comprise a plurality of minute hooks. The loop surface may comprise a surface of uncut pile that acts like a plurality of loops. When the hook surface is applied to the loop surface, the plurality of minute hooks may couple to the plurality of loops securely fastening the hook surface to the loop surface. The hook surface may sometime be referred to as a hard side fastener and the loop surface may sometimes be referred to as a soft side fastener.

As used in this disclosure, "horizontal" may be a directional term that refers to a direction that is perpendicular to the local force of gravity. Unless specifically noted in this disclosure, the horizontal direction is always perpendicular to the vertical direction.

As used in this disclosure, an "interface" may be a physical or virtual boundary that separates two different systems and across which force is exchanged.

As used in this disclosure, a "magnet" may be an ore, alloy, or other material that has its component atoms arranged so that the material exhibits properties of magnetism such as attracting iron-containing objects or aligning itself in an external magnetic field.

As used herein, "MOLLE" may refer to Modular Lightweight Load-carrying Equipment. MOLLE may be used to generically describe all load bearing systems, backpacks, and subsystems that utilize the woven PALS (Pouch Attachment Ladder System) webbing for modular pouch attachment. The system's modularity may be derived from the use of Pouch Attachment Ladder System (PALS) webbing equipment as rows of heavy-duty nylon stitched onto the vest to allow for the attachment of various compatible pouches and accessories. This method of attachment has become a de facto standard for modular tactical gear.

As used in this disclosure, "orientation" may refer to the positioning and/or angular alignment of a first object relative to a second object or relative to a reference position or reference direction.

As used herein, "resilient" may refer to an object or material which may deform when a force is applied to it and which will return to its original shape when the deforming force is removed.

As used herein, "rigid" may refer to an object or material which is inflexible.

As used herein, "swaging" may refer to a method of securing a cable using a permanent sleeve. The sleeve may be completely compressed and deformed around the cable such that the sleeve will not come off of the cable during use—the connection typically exceeds the rated breaking strength of the cable. The enlarged end of a swage cable may retain the cable in a fitting.

As used in this disclosure, a "textile" may be a material that is woven, knitted, braided or felted. Synonyms in common usage for this definition include fabric and cloth.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A load transfer system for tactical plate carriers comprising:

a top interface, a bottom interface, and a linkage;

wherein the top interface couples to an armor plate directly or indirectly via a plate carrier;

wherein the bottom interface couples to anatomically inferior gear located below the top interface;

wherein the top end of the linkage couples to the top interface and the bottom end of the linkage couples to the bottom interface;

wherein the linkage comprises a compression spring, and a linkage member;

wherein a top of the compression spring or the linkage member is coupled to the top interface at a top linkage coupler and a bottom of the compression spring or the linkage member is coupled to the bottom interface at a bottom linkage coupler;

wherein the compression spring or the linkage member conveys the load from the top interface to the bottom interface.

2. The load transfer system for tactical plate carriers according to claim 1 wherein the load transfer system for tactical plate carriers is adapted to be worn by a user to transfer a load from the user's shoulders and/or lower back to the users' hips and pelvis;

wherein the load transfer system for tactical plate carriers permits movement of the armor plate relative to the anatomically inferior gear;

wherein the top interface comprises a plate coupler and the top linkage coupler;

wherein the plate coupler couples to the armor plate and/or to the plate carrier;

wherein the top linkage coupler couples to the top of the linkage;

wherein the top interface is operable to convey the load from the plate coupler to the top linkage coupler and thereby convey the load from the armor plate or the plate carrier to the linkage.

3. The load transfer system for tactical plate carriers according to claim 2 wherein the bottom interface comprises the bottom linkage coupler and a bottom gear coupler;

wherein the bottom linkage coupler couples to the bottom of the linkage;

wherein the bottom gear coupler couples to the anatomically inferior gear;

wherein the bottom interface is operable to convey the load from the bottom linkage coupler to the bottom gear coupler and thereby convey the load from the linkage to the anatomically inferior gear.

4. The load transfer system for tactical plate carriers according to claim 3 wherein the top of the linkage couples to the top linkage coupler of the top interface;

wherein the bottom of the linkage couples to the bottom linkage coupler of the bottom interface;

wherein the linkage is operable to convey the load from the top of the linkage to the bottom of the linkage and thereby convey the load from the top interface to the bottom interface.

5. The load transfer system for tactical plate carriers according to claim 4 wherein the linkage deforms and/or moves relative to the top interface, the bottom interface, or both such that a separation distance between the top interface and the bottom interface and/or orientation of the top interface relative to the bottom interface changes.

6. The load transfer system for tactical plate carriers according to claim 5 wherein the linkage permits the top interface to move up, down, left, right, forward, backward, or any combination thereof relative to the bottom interface, permits rotation of the top interface about a vertical axis relative to the bottom interface, permits rotation of the top interface about any horizontal axis relative the bottom interface, or any combination thereof.

7. The load transfer system for tactical plate carriers according to claim 6 wherein the linkage comprises one or more articulated joints, one or more rods, one or more cables, one or more hydraulic dampers, one or more pneumatic dampers, one or more armatures, one or more springs, or any combination thereof.

8. The load transfer system for tactical plate carriers according to claim 6 wherein an individual coupler selected from the plate coupler, the top linkage coupler, the bottom gear coupler, and the bottom linkage coupler comprises one or more snaps, one or more buckles, one or more hook and loop fasteners, one or more clips, one or more clamps, one or more magnets, one or more ball joints, one or more swages, one or more cable connectors, one or more welded joints, an adhesive, a molle system attachment, a tactical gear attachment, or any combination thereof.

9. The load transfer system for tactical plate carriers according to claim 6 wherein the top interface comprises a plate clip;

wherein the plate clip comprises a slot that is operable to couple to the plate carrier.

10. The load transfer system for tactical plate carriers according to claim 9 wherein the plate clip is coupled to the top interface via a bracket.

11. The load transfer system for tactical plate carriers according to claim 9 wherein the bottom interface comprises a clip;

wherein the clip comprises a downward-oriented hook that slides down onto the anatomically inferior gear from the top.

12. The load transfer system for tactical plate carriers according to claim 11 wherein the linkage further comprises a swage cable.

13. The load transfer system for tactical plate carriers according to claim 11 wherein the compression spring permits the separation distance between the top interface and the bottom interface to decrease by compression of the compression spring;

wherein the linkage member maintains the separation distance between the top interface and the bottom interface.

14. The load transfer system for tactical plate carriers according to claim 13 wherein the coupling between the top interface and the linkage and between the linkage and the bottom interface are recessed seats.

15. The load transfer system for tactical plate carriers according to claim 13 wherein the swage cable is a cable comprising a top cable terminal and a bottom cable terminal;

wherein the swage cable limits the separation distance to a maximum separation distance.

16. The load transfer system for tactical plate carriers according to claim 15 wherein the bottom cable terminal is coupled to the bottom linkage coupler of the bottom interface such that the separation distance between the top interface and the bottom interface is fixed.

17. The load transfer system for tactical plate carriers according to claim 16 wherein the top cable terminal is held captive by the top linkage coupler of the top interface.

* * * * *